US007330001B2

(12) United States Patent
Fischer et al.

(10) Patent No.: US 7,330,001 B2
(45) Date of Patent: Feb. 12, 2008

(54) BALLAST HAVING A DIMMING DEVICE

(75) Inventors: Klaus Fischer, Friedberg (DE); Josef Kreittmayr, Bobingen (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 11/376,413

(22) Filed: Mar. 15, 2006

(65) Prior Publication Data

US 2006/0214601 A1 Sep. 28, 2006

(30) Foreign Application Priority Data

Mar. 22, 2005 (DE) ..... 10 2005 013 308

(51) Int. Cl.
*H05B 37/02* (2006.01)

(52) U.S. Cl. ..... 315/307; 315/DIG. 4; 315/224

(58) Field of Classification Search ..... 315/307, 315/291, DIG. 4, DIG. 2, 224, 301, 302, 315/308, DIG. 5
See application file for complete search history.

(56) References Cited

U.S. PATENT DOCUMENTS 5,914,572 A * 6/1999 Qian et al. ..... 315/DIG. 4
7,075,254 B2 * 7/2006 Chitta et al. ..... 315/307
2005/0212462 A1 * 9/2005 Yu et al. ..... 315/291
2006/0103330 A1 * 5/2006 Hsu ..... 315/291

FOREIGN PATENT DOCUMENTS

DE 39 43 350 A1 7/1991
EP 0 422 255 A1 4/1991

* cited by examiner

*Primary Examiner*—Douglas W. Owens
*Assistant Examiner*—Ephrem Alemu
(74) *Attorney, Agent, or Firm*—Cohen Pontani Lieberman & Pavane LLP

(57) ABSTRACT

A ballast having a dimming device for a low-pressure discharge lamp. It has two technically different possibilities for controlling the lamp brightness. The first possibility for controlling the lamp brightness is by means of adjusting the amplitude of the lamp current. The second possibility for brightness control is based on the fact that the low-pressure discharge lamp can be operated with a pulsed lamp current. In particular, both operating modes are used in combination in specific brightness ranges.

13 Claims, 3 Drawing Sheets

BALLAST HAVING A DIMMING DEVICE

FIELD OF THE INVENTION

The present invention relates to an electronic ballast having a dimming device for the purpose of controlling the lamp brightness of a low-pressure discharge lamp, and to a method for controlling the lamp brightness of a low-pressure discharge lamp.

BACKGROUND OF THE INVENTION

Electronic ballasts for operating low-pressure discharge lamps are known in many embodiments. They generally contain a rectifier circuit for the purpose of rectifying an AC voltage supply and charging a capacitor, often referred to as a smoothing capacitor. The DC voltage applied to this capacitor serves the purpose of supplying an inverter which operates the low-pressure discharge lamp. In principle, an inverter produces a supply power for the lamp from a rectified AC voltage supply or a DC voltage supply, said supply power having a much higher frequency than the system frequency. Similar devices are also known for other types of lamps, for example in the form of electronic transformers for halogen lamps.

Dimming devices for operating electronic ballasts for the purpose of controlling the brightness of low-pressure discharge lamps are known per se.

A known possibility for brightness control in this case consists in the lamp power and thus the lamp brightness being adjusted by means of regulating the amplitude of the lamp current. This can take place by bringing the operating frequency of the inverter closer to or further away from resonant frequencies of the lamp/inverter system.

SUMMARY OF THE INVENTION

One object of the invention is to provide an electronic ballast which is improved in terms of lamp brightness control.

This and other objects are attained in accordance with one aspect of the present invention directed to an electronic ballast having a dimming device for the purpose of controlling the brightness of a low-pressure discharge lamp by means of adjusting the amplitude of the lamp current. The dimming device is also designed to operate the low-pressure discharge lamp by means of lamp current pulses having time intervals and to implement brightness control by adjusting the duty ratio between the pulse duration and the interpulse interval of the lamp current. The dimming device is also designed to implement brightness control differently, firstly in a first brightness range and secondly in a further brightness range having a lower brightness than in the first brightness range. The dimming device is also designed to implement brightness control in the first brightness range at least also by means of adjusting the amplitude of the lamp current and, in the further brightness range, at least also by adjusting the duty ratio between the pulse duration and the interpulse interval of the lamp current.

Another aspect of the invention is directed to a corresponding method for operating an electronic ballast.

A notable difference from the prior art is the fact that the invention provides an electronic ballast which has two technically different possibilities for controlling the lamp brightness. Depending on the embodiment of the invention, these two possibilities can supplement one another in different ways in various brightness ranges. Various embodiments of the invention can control the brightness in different brightness ranges either using one of the two possibilities or else using both possibilities together. As is described below, brightness control by means of adjusting the amplitude has specific advantages in particular also at higher brightness values, whereas the adjustment of the duty ratio demonstrates its particular advantages in particular also at lower brightness values. The invention therefore provides at least two brightness ranges which are different in terms of brightness control or the "dimming method", in which case, in a so-called first brightness range at higher brightness values, at least amplitude adjustment is used and, in a further brightness range, at least duty ratio adjustment is used. The number of different brightness ranges, their extent and the choice of the method(s) of brightness control in these ranges depend, moreover, on the specific embodiment of the invention and on the specific principal advantages.

The first of the two possibilities for brightness control, which is included in any embodiment of the invention, is control of the lamp brightness by means of adjusting the amplitude of the lamp current. For conventional low-pressure discharge lamps, this allows for flicker-free brightness control for high and medium lamp currents. In the case of low lamp currents, however, this possibility fails in many cases because, as the lamp current becomes lower, the lamp voltage increases until the electronic ballast can no longer make the lamp voltage available. The lamp current dies out and thus the gas discharge is extinguished.

The second of the two possibilities for brightness control is based, according to the invention, on the fact that any embodiment of the invention can operate the low-pressure discharge lamp even using pulsed lamp current. For reasons of simplicity, current pulses and breaks between these pulses, the interpulse intervals, are referred to below. During a current pulse, a high-frequency, approximately sinusoidal lamp current flows; a current pulse can be characterized by its duration and the amplitude of the lamp current oscillations during the pulse. The longer a current pulse, the more high-frequency current oscillations it contains.

During the interpulse intervals, no lamp current flows, or at least only little lamp current flows in comparison to the current flow during the current pulses. The lamp brightness can be adjusted using the duration of the current pulses and/or the duration of the interpulse intervals. Overall, the lamp brightness is altered using the duty ratio of current pulses and interpulse intervals.

Low, medium and high lamp currents can be used with such brightness control, with the result that the lamp brightness appears to be flicker-free. In particular, the lamp brightness can be reduced to a greater extent than when using the first possibility of brightness control with an unpulsed lamp current. The reason for this is the fact that the lamp current can remain so high within a pulse that the lamp voltage for the ballast does not assume critically high values and the pulsed method nevertheless allows for a reduction in the average injected power. This first prevents the inverter from no longer being able to continuously make the lamp voltage available and prevents it from extinguishing the gas discharge, and, secondly, the dependence of the lamp current on the lamp voltage is no longer so great in the case of higher lamp currents. The lamp brightness thus no longer responds so severely to small current fluctuations. It is thus also possible to operate the low-pressure discharge lamp in a flicker-free manner in a large ambient temperature range even at low brightnesses since the dependence of the lamp voltage on the lamp current at low temperatures is particularly pronounced in the case of low lamp currents.

However, it may be that control of the lamp brightness exclusively using the duty ratio of the current pulses and the interpulse intervals is not advantageous in the case of certain ballasts at very high brightness values. When a resonant half-bridge arrangement is used as the inverter, it may be the case that it is not possible to switch over between the interpulse interval and the current pulse as quickly as desired since the system comprising the inverter and the low-pressure discharge lamp cannot always be brought from one state to the other state quickly enough. In particular, the lamp current cannot be reduced suddenly to zero when an inverter operating at resonance is used. A technically relevant minimum interpulse interval can thus be provided. The temporal extent of this minimum interpulse interval depends, inter alia, on the amplitude of the lamp current at the end of a current pulse. The greater the amplitude of the lamp current, the longer the minimum interpulse interval. At lower lamp currents, the minimum interpulse interval is shorter. When there is merely adjustment of the duty ratio between the pulse duration and the interpulse interval of the lamp current, it may be the case that it is not possible for the maximum brightness of the lamp to be reached in a stepless manner. This brightness range is then only achieved with an unpulsed current and by means of amplitude adjustment.

The invention makes it possible to control the lamp brightness by means of a combination of adjustment of the amplitude of the lamp current and adjustment of the duty ratio of current pulses. It is thus possible for the respective merits of the two methods to be used in various brightness ranges of the lamp. In each case one of the above-described methods or both of the above-described methods in combination can be used in preferably two or three brightness ranges. The invention is not restricted to a specific breadth of the brightness ranges. The invention can, for example, be designed such that the method is carried out at lower and medium lamp currents by means of modulating the duty ratio of the current pulses. At higher lamp currents, the brightness control can then be implemented by means of adjusting the lamp current amplitude. It is thus then possible for the maximum brightness of the lamp to be reached at higher lamp currents. At lower lamp currents, lower brightnesses can be achieved than when using the unpulsed operating method. The free choice of the boundaries of the brightness ranges of the lamp in which the brightness can be controlled in various ways makes it possible to provide the boundaries of the brightness ranges such that a possible jump in the brightness, for example on transition from continuous lamp current to pulsed lamp current, caused by the minimum possible interpulse interval cannot be perceived. This is possible because the minimum interpulse interval becomes smaller as the lamp current decreases.

In one preferred embodiment, it is possible to start in a first brightness range, at high lamp currents, with continuous current and then to reduce the amplitude in order to reduce the brightness. From a medium brightness on, it is now possible, in a second brightness range, for the current also to be pulsed; a further reduction can be brought about by a combined reduction in the amplitude and change in the duty ratio. The jump in the lamp brightness, caused by the minimum interpulse interval, is, as stated, not so pronounced at a medium brightness as a corresponding jump owing to the transition to pulsed lamp currents at maximum amplitude.

The reduction in the brightness in this second brightness range owing to a combined reduction in the current amplitude and an increase in the interpulse interval can also be continued until there is a threat of the gas discharge being interrupted.

However, it is also possible, for example, to not reduce the amplitude any more in a third brightness range, below a specific lamp brightness, and for the lamp brightness to only be reduced by a change in the duty ratio between the pulse duration and the interpulse interval. If required, it is possible to achieve a situation in which the charge carrier density produced within a pulse is sufficiently high to avoid complete recombination of the charge carriers during longer interpulse intervals.

Finally, the second brightness range with a combined use of both possibilities for brightness adjustment can also be dispensed with; a brightness range with exclusive duty ratio adjustment can thus follow on from a brightness range with exclusively amplitude adjustment.

Owing to the many possibilities provided by the refinement of the invention, the selection of the subdivision of the brightness ranges and the combination of the possibilities for controlling the lamp current can be adapted to the technical and physical properties of the individual low-pressure discharge lamp. They may differ greatly from one another in terms of their properties depending on their design.

Short low-pressure discharge lamps having a large discharge vessel diameter tend to have less dependence of the lamp voltage on the lamp current, even at low lamp currents. Satisfactory dimming with operation corresponding to the first and second brightness range can therefore be achieved with these lamps.

Very thin and long low-pressure discharge lamps have a pronounced dependence of the lamp voltage on the lamp current. It may be expedient here only to operate with the first and third brightness ranges.

In addition, it is true for all forms of discharge vessel that the dependence of the lamp voltage on the lamp current increases with decreasing temperature primarily at low lamp currents.

In one embodiment of the invention with discrete brightness stages or if a low-pressure discharge lamp according to the invention is not required to reach the technically maximum possible brightness, the lamp can also manage with the second and third brightness ranges.

It results from the above explanations that the "further" brightness range can be realized in the sense of the independent claims by the second or the third brightness range. The preceding paragraph makes it clear that the "first" brightness range in the sense of the independent claims can also be implemented in specific embodiments by operation referred to here as the second brightness range, in which the lamp current amplitude and the duty ratio are altered.

In order to produce the pulsed lamp current, an inverter is preferably driven using a pulsed signal, for example a voltage signal. For each desired lamp brightness there is in each case one temporally continuous signal, whose signal variable depends on the desired lamp brightness. The invention has a signal generator for the purpose of generating periodic signals. These signals may be, for example, triangular-waveform or saw-tooth voltages. A comparison device compares the periodic signal with the continuous signal corresponding to the desired brightness. If the continuous signal for a specific brightness is always greater (or less) than the periodic signal, a continuous signal is also passed on to the inverter. If there is a small "overlap"—the periodic signal is in each case greater (or less) than the continuous signal corresponding to a specific brightness in the vicinity of its maxima (optionally also minima)—this overlap defines small interpulse intervals. Thereupon, a pulsed signal with short interpulse intervals is passed on to the inverter. If the overlap becomes slightly greater, the interpulse intervals become longer. If in this case almost the entire periodic signal is above (or below) the continuous signal corresponding to a specific brightness, the overlap of the minima (or maxima) of the periodic signal with the constant signal defines the remaining times in which a notable lamp current flows. The pulses are now short and the interpulse intervals are long. If the periodic signal is completely above (or below) the continuous signal, the comparison device determines the signal input at the inverter, and a constant, small or diminishing lamp current flows.

In one preferred refinement of the invention, the output signal from the signal generator is synchronized with the phase angle of the supply voltage of the inverter, which fluctuates at a low frequency, for example, as a result of rectification of a system voltage. It is thus possible to avoid beat frequencies which may be perceived as flickering of the lamp brightness.

One preferred refinement of the invention provides for the inverter to be controlled via a closed-loop control circuit. For this purpose, the invention has a measuring device which measures the lamp current and converts it into a controlled variable. Alternatively, this measuring device can also measure the operating frequency of the inverter, or another variable associated with the lamp current, in order to convert it into a controlled variable.

Furthermore, a regulator is then provided. The regulator driving the inverter receives three input signals. The first input signal corresponding to a controlled variable is received by the regulator from the measuring device for measuring the lamp current. The second input signal codes the desired lamp brightness in the form of a temporally continuous signal, whose variable is different for each desired brightness; it corresponds to the guide variable. The third input signal determines the time structure of the manipulated variable of the regulator. During the interpulse intervals, the third input signal sets the manipulated variable of the regulator to a value which allows the low current typical for interpulse intervals to flow in the low-pressure discharge lamp or completely suppresses the current flow. Outside the interpulse intervals, it has no influence on the manipulated variable. The third input signal thus also codes the desired brightness.

The regulator thus receives information on the desired brightness via two different paths. A continuous signal which is different for each desired brightness is transmitted via the first of the two paths. In the case of simple amplitude adjustment of the lamp brightness, this signal corresponds to the desired brightness. This signal is downwardly clamped. This means that the regulator never allows the amplitude of the lamp current to fall below a minimum which can be set, at the boundary between the second and the third brightness ranges. This may be desirable at low lamp currents, in which case control of the brightness only now takes place by means of the duty ratio of the pulse duration and the interpulse interval. The time structure of the manipulated variable is determined via the second path.

A further preferred refinement of the invention provides a circuit arrangement for measuring the lamp resistance, as described, for example, in EP 0 422 255 B1. The measured variable is converted into a controlled variable, for example a voltage signal, and acts as an additional input for the regulator. If the resistance of the discharge lamp is increasing, the regulator can drive the inverter such that interruption of the gas discharge owing to the increase in the lamp current is prevented.

Since the invention can manage without additional power components in the load circuit, it may have a compact design, if required. The invention is therefore preferably suitable for integrating the electronic ballast in low-pressure discharge lamps, in particular compact fluorescent lamps (CFLs).

DETAILED DESCRIPTION OF THE DRAWINGS

Figure 1:
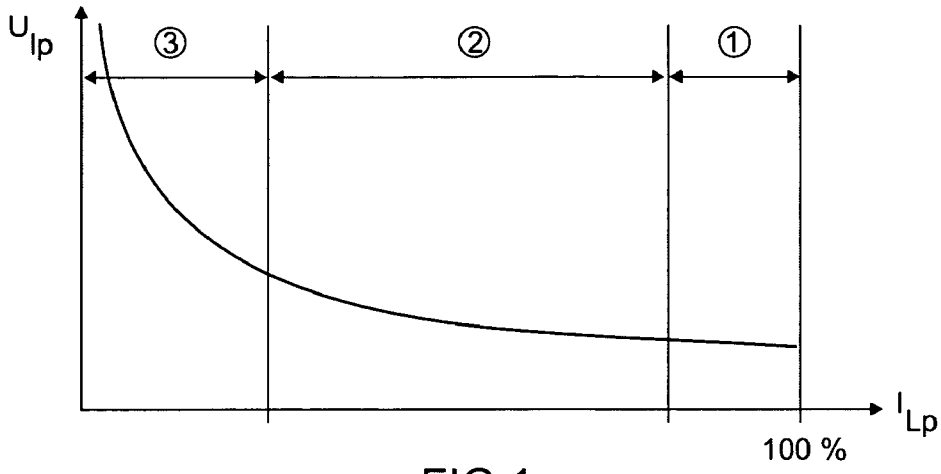
FIG. 1 shows the dependence of the lamp voltage of a compact fluorescent lamp according to the invention on the lamp current; three brightness ranges of interest are illustrated.

FIG. 1 illustrates the lamp voltage of a low-pressure discharge lamp according to the invention as a function of the lamp current, the lamp characteristic. The lamp voltage initially only increases moderately starting from a minimum at a maximum lamp current as the lamp current is reduced, the dependence of the lamp voltage on the lamp current is low; brightness range 1 in FIG. 1. On a further reduction in the lamp current, the lamp voltage increases to an even greater extent, the dependence of the lamp voltage on the lamp current is increasingly pronounced; brightness ranges 2 and 3 in FIG. 1. When the current falls below a minimum lamp current, the gas discharge is interrupted if the required voltage cannot be provided by the inverter. The limited output voltage of the inverter thus defines the minimum lamp current at which the lamp can still be operated continuously, and thus the minimum brightness of the lamp given unpulsed lamp current.

With a pulsed lamp current, however, lower medium lamp brightnesses can be achieved. In this case, the low-pressure discharge lamp is operated alternately with quick changeover to two points of the lamp characteristic. In the interpulse intervals, at low or diminishing lamp currents, the corresponding lamp current is at the far left on the lamp voltage/lamp current characteristic. During the pulses, the operating range at higher lamp currents is further to the right on the lamp voltage/lamp current characteristic. At higher currents, the voltage of the low-pressure discharge lamp is lower and operation of the low-pressure discharge lamp is very robust, for example with respect to temperature dependence, which is not so severely pronounced at higher lamp currents.

As shown in FIG. 1, the entire brightness range is divided into three brightness ranges according to the invention. In a first brightness range between the maximum possible brightness and a medium brightness value, the amplitude of the lamp current is reduced from a maximum value to a medium value. In this first brightness range, the lamp current is not pulsed; its amplitude determines the brightness of the lamp.

Figure 2A:
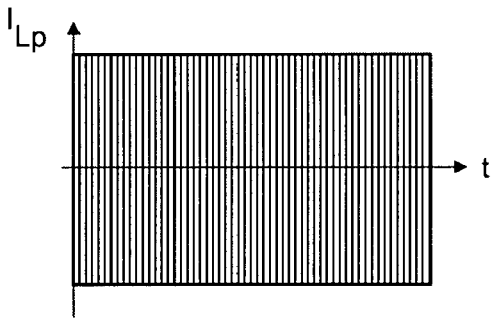
FIGS. 2*a, b* show the unpulsed lamp current as a function of time with two different amplitudes.
Figure 2B:
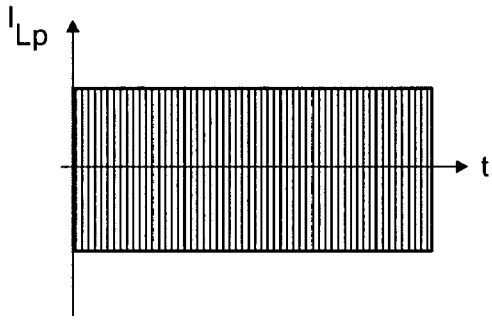

FIG. 2*a* shows the lamp current at a maximum brightness of the lamp; FIG. 2*b* shows the lamp current at a brightness close to the lower boundary of the first brightness range. It can be seen that only the amplitude changes.

Following on from the end of the first brightness range and up to a lower lamp brightness, the amplitude of the lamp current in a second range is reduced further. In addition, the lamp current is divided into pulses and interpulse intervals. There are thus times in which lamp current flows and times in which no lamp current flows.

Figure 3A:
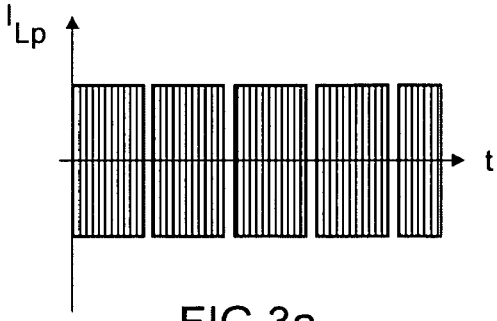
FIGS. 3*a, b* show two examples of the pulsed lamp current having different duty ratios between the pulse duration and the interpulse interval and in each case a different amplitude.
Figure 3B:
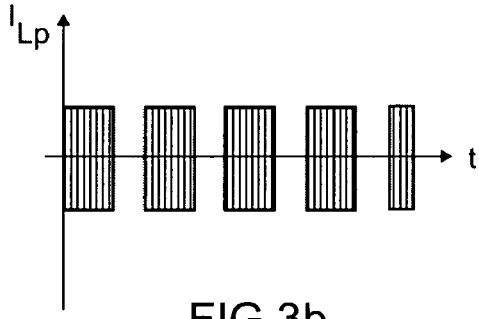

At brightnesses which are just at the boundary to the first brightness range, the duration of the interpulse intervals is minimal; the duration of the times with lamp current is maximal, as shown in FIG. 3*a*. FIG. 3*b* shows the lamp current at a lower brightness than in FIG. 3*a*.

Figure 4A:
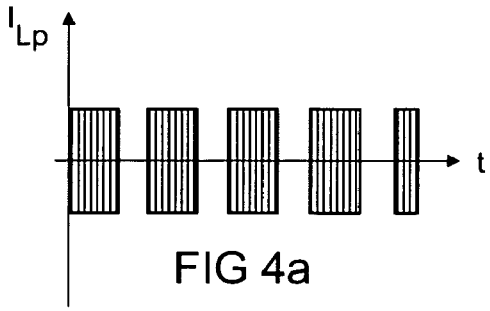
FIGS. 4*a, b* show two examples of the pulsed lamp current having different duty ratios between the pulse duration and the interpulse interval and in each case an identical amplitude.
Figure 4B:
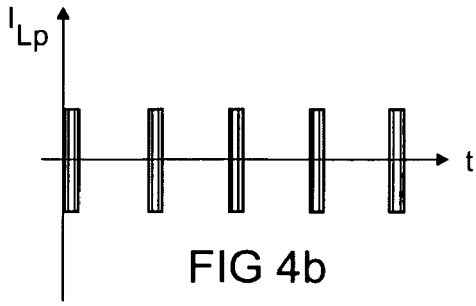

Following on from the second brightness range is a third brightness range. This extends up to the minimum brightness. The amplitude of the lamp current is no longer changed in this third brightness range. In this third brightness range, only the duty ratio of lamp current pulses of constant amplitude is adjusted. FIG. 4*a* shows the lamp current at a brightness close to the boundary to the second brightness range; FIG. 4*b* shows the lamp current at minimum brightness. The duration of the interpulse intervals needs to be shorter there than the time in which the charge carriers in the lamp can completely recombine. The recombination time determines the maximum interpulse interval.

Figure 5:
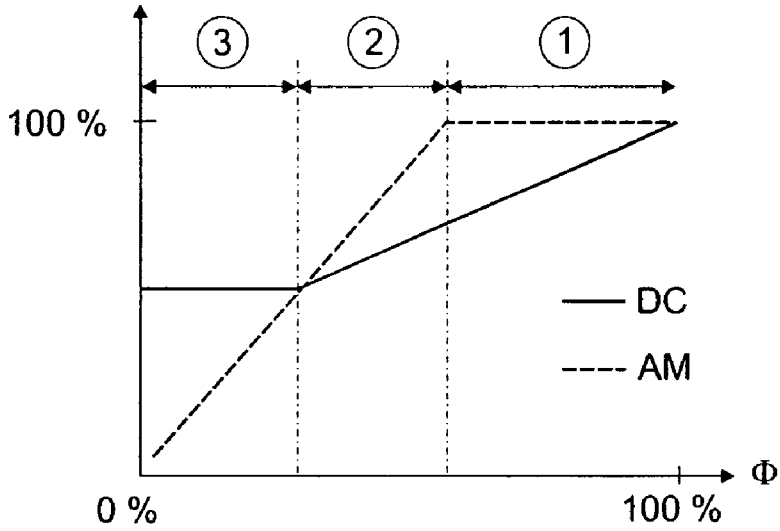
FIG. 5 shows a schematic of the amplitude of the lamp current and the duty ratio between the pulse duration and the interpulse interval as a function of the lamp brightness. Three brightness ranges of interest are illustrated.

FIG. 5 shows the dependence of the amplitude AM of the envelope of the lamp current and its duty ratio DC on the brightness Φ of the lamp. Said three brightness ranges are illustrated.

The boundary between the first and second brightness ranges should preferably be at a lamp brightness Φ at which no sudden change in the lamp brightness Φ can be perceived visually by the introduction of the minimum interpulse interval. The lower the lamp current amplitudes, the shorter the minimum interpulse intervals.

The boundary between the second and third brightness ranges is preferably set such that the amplitude of the lamp current is sufficiently high during the pulses in order to obtain a lamp voltage which can be made available by the inverter. In addition, the charge carrier density in the lamp would become too low at a smaller amplitude than the minimum amplitude. Too many charge carriers could thus recombine in the break, and the gas discharge would have to be struck again after each interpulse interval.

Figure 6:
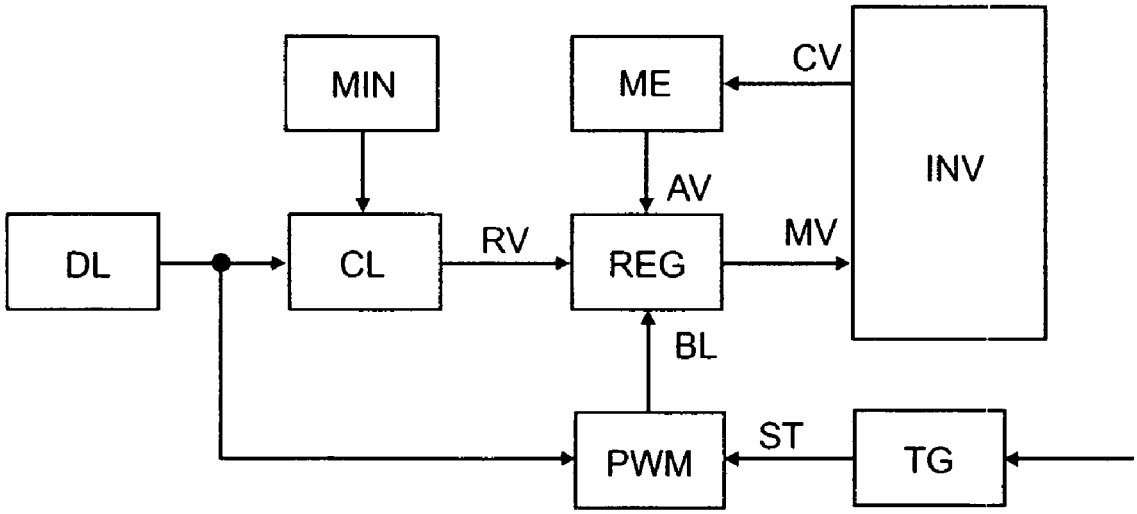
FIG. 6 shows an arrangement for controlling the brightness of the low-pressure discharge lamp.

FIG. 6 shows a circuit arrangement according to the invention for controlling the brightness of a low-pressure discharge lamp. A first desired value DL is used for regulating the brightness, and this desired value DL has a strictly monotonic relationship with the desired brightness, with a minimum value corresponding to the minimum brightness and a maximum value corresponding to the maximum brightness. It is equally possible for the correlation between DL and the desired brightness to be selected to be inversely proportional. The desired value DL is passed to a comparator circuit PWM and to a clamping circuit CL. The comparison circuit PWM may be in the form of, for example, a comparator having an open collector output. The clamping circuit CL may comprise, for example, two diodes, whose cathodes are connected to the output and whose anodes are provided with the first desired value DL or the minimum value MIN.

The clamping circuit CL generates an output signal RV which is identical to the first desired value DL above a specific value MIN. For values of DL which are less than MIN, RV is identical to MIN. The signal RV is supplied to a regulator REG as a desired value. The regulator REG may be in the form of, for example, a PI controller.

The signal DL is compared with the output signal from a triangular-waveform generator TG in the comparison circuit PWM, an output signal BL being generated. The frequency and amplitude of the triangular-waveform signal, for example produced by a self-oscillating circuit, can be set freely.

The output signal BL is passed to the regulator REG. The signal BL has two states. The first state acts on the regulator REG so as to make it produce an output signal which, via the manipulated variable MV, brings the inverter into a state in which no, or virtually no, lamp current flows. These times correspond to the interpulse intervals. In the second state, the regulator REG is not influenced by the signal BL. The open collector output of the comparison circuit PWM in the first case draws the guide variable to a value which leads to a manipulated variable corresponding to the interpulse intervals. In the second case the regulator is not influenced by BL.

The regulator REG controls the operating frequency of the inverter INV via its output signal MV, said inverter INV operating a low-pressure discharge lamp. Furthermore, the inverter INV makes available a variable CV which is proportional to the lamp current. The variable CV can in this case be the lamp current itself or the operating frequency of the inverter.

The measuring device ME produces a signal AV from the variable CV, and this signal AV is passed to the regulator REG as a controlled variable.

Figure 7A:
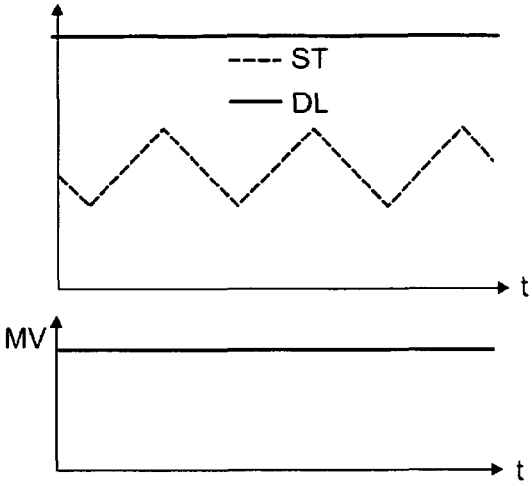
FIGS. 7*a-f* show (in 6 subfigures) the manner in which a drive signal is generated for the operation of the low-pressure discharge lamp, by means of a comparison.

In the event of a change in the desired brightness, starting from the maximum brightness, initially the signal DL has its maximum value, which is greater than the signal ST. The manipulated variable MV is at a maximum for this brightness and is continuous over time, as shown in FIG. 7*a*. In order to reduce the brightness, DL is made smaller, and MV thus becomes smaller.

Figure 7B:
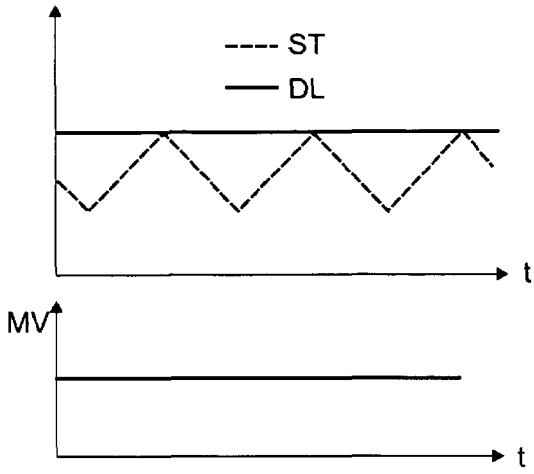
Figure 7C:
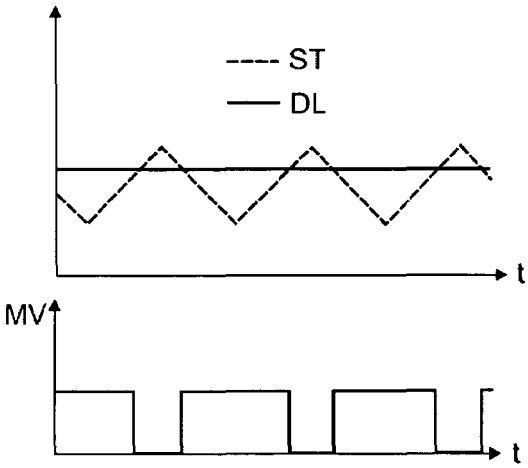
Figure 7D:
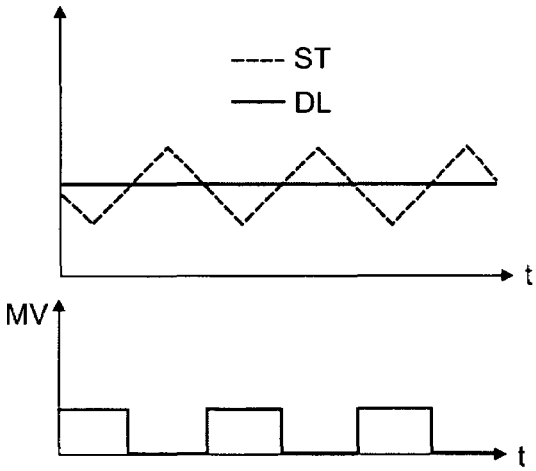
Figure 7E:
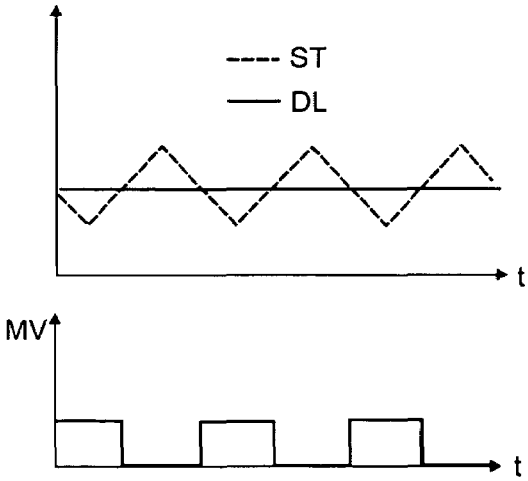
Figure 7F:
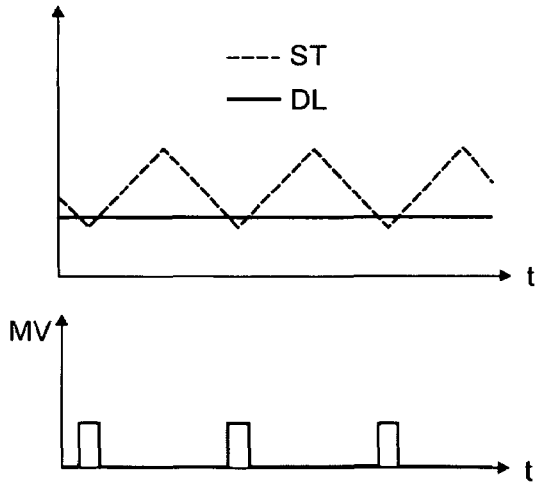

As long as DL and ST do not overlap, MV remains continuous; FIG. 7*b*. If DL is reduced further, times occur at which DL is smaller than the maxima of the triangular-waveform signal ST; FIG. 7*c*. During these phases, the inverter is controlled by means of MV such that no (or virtually no) lamp current flows. On a further reduction in DL, the phases without lamp current firstly become longer, and secondly the value of MV continues to be reduced in the phases in which lamp current flows, and thus also the amplitude of the lamp current pulses; FIG. 7*d*. On a further reduction in DL, the phases in which no lamp current flows are longer. The amplitude of MV and thus that of the lamp current remain constant during the pulses, however; FIGS. 7*e* and 7*f*.

The minimal brightness corresponds to a minimum signal DL. This minimum signal is selected such that the triangular-waveform signal ST is never completely above the signal DL. The minima of ST are always below DL. The distance between the minima of ST thus also defines the maximum interpulse interval.

When the inverter is supplied with an intermediate circuit voltage, this intermediate circuit voltage is generally not constant over time but will have fluctuations corresponding to the periodicity of the supply system. The frequency of the modulation signal is much greater. Beat frequencies may occur which may be perceived as flicker on the low-pressure discharge lamp. In order to prevent this, the phase angle of the triangular-waveform signal can be synchronized with the phase angle of the system frequency. For example, it is possible with a suitable circuit for a rising edge of the triangular-waveform signal to be produced always at the time of the system maximum.

With a small signal DL, there is an increased risk of the discharge being extinguished. In order to prevent this, the circuit known from EP 0 422 255 B1 can be used in order to measure the discharge resistance. If this increases severely, an interruption in the discharge is directly imminent.

Based on the knowledge of the discharge resistance, an additional controlled variable can be fed to the regulator REG such that the lamp current is increased if there is threat of the lamp being extinguished.

We claim:

1. An electronic ballast having a dimming device for controlling brightness of a low-pressure discharge lamp by means of adjusting an amplitude of current applied to the lamp, comprising;

means for operating the dimming device for applying to the low-pressure discharge lamp current pulses having a pulse duration and time intervals between two pulses and controlling the brightness by adjusting a duty cycle of the lamp current pulses;

wherein the dimming device operates the low-pressure discharge lamp in a first operating mode having a first brightness range and a second operating mode in a second brightness range having a lower brightness than the first brightness range; and wherein the brightness control in the first brightness range also occurs by means of adjusting the amplitude of the lamp current pulses and, in the second brightness range, also occurs by adjusting the duty cycle of the lamp current pulses.

2. The electronic ballast as claimed in claim 1, wherein the electronic ballast is configured to implement control of the brightness in the first brightness range only by adjusting the amplitude of the lamp current.

3. The electronic ballast as claimed in claim 1, wherein the electronic ballast is configured to implement control of the brightness in the second brightness range by adjusting the amplitude of the lamp current and by adjusting the duty cycle of the lamp current pulses.

4. The electronic ballast as claimed in claim 1, wherein the electronic ballast is configured to implement control of the brightness in a third brightness range only by adjusting the duty cycle of the lamp current pulses.

5. The electronic ballast as claimed in claim 1, further comprising:

a device for producing the lamp current pulses; said device including a signal generator for generating a periodic signal; and a device for comparing the periodic signal with a continuous signal corresponding to a desired brightness;

wherein an overlap between the periodic signal and the continuous signal determine a duration of the signal pulses and their interpulse interval.

6. The electronic ballast as claimed in claim 5, further comprising:

a device for synchronizing spaced-apart signal pulses with a supply voltage of an inverter for generating the lamp current;

wherein an the output signal from the signal generator is synchronized with a phase angle of the supply voltage of the inverter, which fluctuates at a low frequency.

7. The electronic ballast as claimed in claim 6, further comprising:

an inverter for producing the lamp current;

a measuring device for measuring the lamp current or a variable dependent on the lamp current and for producing a controlled variable; and a regulator for controlling the inverter.

8. The electronic ballast as claimed in claim 7, wherein the electronic ballast is configured to supply the output from a comparison device to the regulator as a blocking signal.

9. The electronic ballast as claimed in claim 7, further comprising:

a device for preventing an interruption of gas discharge;

wherein the device is configured to measure resistance of the lamp and convert the measured lamp resistance into an additional controlled variable.

10. The electronic ballast as claimed in claim 7, further comprising:

a device for clamping a signal corresponding to the desired brightness;

wherein under all circumstances at least one minimum signal, which acts as a guide variable, reaches the regulator during the lamp current pulses.

11. A low-pressure discharge lamp having an integrated electronic ballast as claimed in claim 1.

12. A method for controlling brightness of a low-pressure discharge lamp by means of an electronic ballast having a dimming device by controlling the amplitude of the lamp current, comprising:

operating the low-pressure discharge lamp with lamp current pulses;

adjusting a duty cycle of the lamp current pulses to control the brightness; and operating the low-pressure discharge lamp in at least two different modes with a first operating mode in a first brightness range and a second operating mode in a second brightness range having a lower brightness than the first brightness range;

wherein brightness control in the first brightness range also occurs at least by means of adjusting the amplitude of the lamp current and, in the second brightness range, also occurs at least by adjusting the duty cycle of the lamp current pulses.

13. The method as claimed in claim 12, wherein the method is implemented via the electronic ballast.

* * * * *